US008764182B2

(12) United States Patent
Ogawa et al.

(10) Patent No.: US 8,764,182 B2
(45) Date of Patent: Jul. 1, 2014

(54) IMAGE FORMING APPARATUS INCLUDING SHEET CUTTING DEVICE

(75) Inventors: Masato Ogawa, Kanagawa (JP); Masahiko Yamada, Tokyo (JP); Yuichiro Maeyama, Kanagawa (JP); Kazuhiro Wakamatsu, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 13/293,517

(22) Filed: Nov. 10, 2011

(65) Prior Publication Data

US 2012/0140010 A1 Jun. 7, 2012

(30) Foreign Application Priority Data

Dec. 1, 2010 (JP) ..... 2010-268565

(51) Int. Cl.
*B41J 2/01* (2006.01)

(52) U.S. Cl.
USPC ..... 347/104; 347/101

(58) Field of Classification Search
USPC ..... 347/101, 104; 346/24; 400/621; 83/483, 83/564, 614, 620, 623, 659
See application file for complete search history.

(56) References Cited

U.S. PATENT DOCUMENTS

| | | | | |
|---|---|---|---|---|
| 5,838,354 | A * | 11/1998 | Yamada et al. | 347/101 |
| 6,315,474 | B1 * | 11/2001 | Giles et al. | 400/621 |
| 2001/0000463 | A1 * | 4/2001 | Kaya | 400/621 |
| 2002/0126193 | A1 * | 9/2002 | Maki et al. | 347/104 |
| 2011/0064497 | A1 | 3/2011 | Niihara et al. | |
| 2011/0211210 | A1 | 9/2011 | Niihara et al. | |

FOREIGN PATENT DOCUMENTS

| | | |
|---|---|---|
| JP | 2008-12863 | 1/2008 |
| JP | 2009-214200 | 9/2009 |

* cited by examiner

*Primary Examiner* — Manish S Shah
*Assistant Examiner* — Yaovi Ameh
(74) *Attorney, Agent, or Firm* — Cooper & Dunham LLP

(57) ABSTRACT

An image forming apparatus includes a recording head, a head holder, a cutter, and a cutter holder. The recording head ejects ink onto a sheet of recording media fed along a sheet feed path to record an image on the sheet. The head holder holds the recording head. The cutter includes opposed blades opposing each other with the sheet interposed therebetween. The cutter holder holds the cutter and is reciprocally movable in a width direction of the sheet perpendicular to a sheet feed direction in which the sheet is fed along the sheet feed path. The cutter holder is disposed downstream from the recording head in the sheet feed direction and within a width of the head holder in the sheet feed direction.

13 Claims, 8 Drawing Sheets

IMAGE FORMING APPARATUS INCLUDING SHEET CUTTING DEVICE

CROSS-REFERENCE TO RELATED APPLICATIONS

This patent application is based on and claims priority pursuant to 35 U.S.C. §119 to Japanese Patent Application No. 2010-268565, filed on Dec. 1, 2010, in the Japanese Patent Office, the entire disclosure of which is hereby incorporated by reference herein.

TECHNICAL FIELD

This disclosure relates to an image forming apparatus, and more specifically to an image forming apparatus including a sheet cutting device to cut a rolled sheet to a desired length.

DESCRIPTION OF THE BACKGROUND ART

Image forming apparatuses are used as printers, facsimile machines, copiers, plotters, or multi-functional devices having two or more of the foregoing capabilities. As a conventional type of image forming apparatus, an image forming apparatus is known that feeds a long-size rolled sheet (hereinafter, rolled sheet) in a certain feed direction (hereinafter, sheet feed direction) to form an image on the rolled sheet.

The image forming apparatus typically has a sheet cutting device to cut the rolled sheet to a desired length by moving a cutter in a direction perpendicular to the sheet feed direction (hereinafter, width direction). The cutter used in the sheet cutting device may be, for example, a pair of circular blades to cut sheets of different thicknesses or materials. In particular, recently, such cutters are widely used in inkjet-type image forming apparatuses capable of forming images on sheets of different thicknesses or materials.

Such a conventional sheet cutting device having the cutter formed with the pair of circular blades needs to return a cutter holder holding the cutter to an initial position (home position) in preparation for the next sheet cutting. At this time, if a forward path along which the cutter moves to cut the sheet is identical to a backward path along which the cutter moves to return to the home position, the cutter contacts the already-cut sheet on the backward path, thus hampering movement of the cutter holder (so-called "cut jam") or causing other failure.

To prevent such a cut jam or other failure, for example, JP-2009-214200-A proposes an image forming apparatus including a sheet cutting device in which the backward path of the cutter formed with the pair of circular blades differs from the forward path of the cutter. Relative to the forward path, the backward path is arranged at a downstream side in the sheet feed direction in which the sheet is fed along a sheet feed path indicated by a broken line P in FIG. 16 and at a position away from a leading edge of a subsequent divided sheet upstream from the cutter in the sheet feed direction. Specifically, after the cutter finishes the cutting operation, the cutter holder is tilted toward the downstream side in the sheet feed direction around a guide member for guiding the movement of the cutter holder. Thus, the position of the cutter moving along the backward path in the sheet feed direction is shifted to the downstream side in the sheet feed direction relative to the position of the cutter moving along the forward path.

Such a configuration can prevent the cutter from contacting the already-cut sheet on the backward path, thus preventing a cut jam. However, in the image forming apparatus described in JP-2009-214200-A, as illustrated in FIG. 16, the cutter holder 510 and the carriage 150 holding the recording head 160 are arranged independently of each other and in tandem in the sheet feed direction indicated by an arrow FD. As a result, the width $W_0$ of the image forming apparatus in the sheet feed direction is relatively large. In addition, because the cutter holder is tilted toward the downstream side in the sheet feed direction, the image forming apparatus requires space for the cutter holder to pivot at the downstream side in the sheet feed direction, thus increasing the width $W_0$ of the image forming apparatus. Thus, the sheet cutting device described in JP-2009-214200-A increases the width of the image forming apparatus and, as a result, increases the size of the image forming apparatus.

As described above, in the image forming apparatus, the forward path of the cutter differs from the backward path, thus preventing the cutter from contacting the cut sheet. However, the cutter holder still remains on the sheet feed path after cutting operation. As a result, a subsequent sheet cannot be fed from the rolled sheet until the cutter and the cutter holder return to the home position, thus hampering gains in productivity.

BRIEF SUMMARY

In an aspect of this disclosure, there is provided an improved image forming apparatus including a recording head, a head holder, a cutter, and a cutter holder. The recording head ejects ink onto a sheet of recording media fed along a sheet feed path to record an image on the sheet. The head holder holds the recording head. The cutter includes opposed blades opposing each other with the sheet interposed therebetween. The cutter holder holds the cutter and is reciprocally movable in a width direction of the sheet perpendicular to a sheet feed direction in which the sheet is fed along the sheet feed path. The cutter holder is disposed downstream from the recording head in the sheet feed direction and within a width of the head holder in the sheet feed direction.

In another aspect of this disclosure, there is provided an improved image forming apparatus including a recording head, a head holder, a cutter, and a cutter holder. The recording head ejects ink onto a sheet of recording media fed along a sheet feed path to record an image on the sheet. The head holder holds the recording head and is reciprocally movable in a width direction of the sheet perpendicular to a sheet feed direction in which the sheet is fed along the sheet feed path. The cutter includes opposed blades opposing each other with the sheet interposed therebetween. The cutter holder holds the cutter and is reciprocally movable in the width direction of the sheet independently of the head holder. The cutter holder is disposed downstream from the recording head in the sheet feed direction and within a width of the head holder in the sheet feed direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
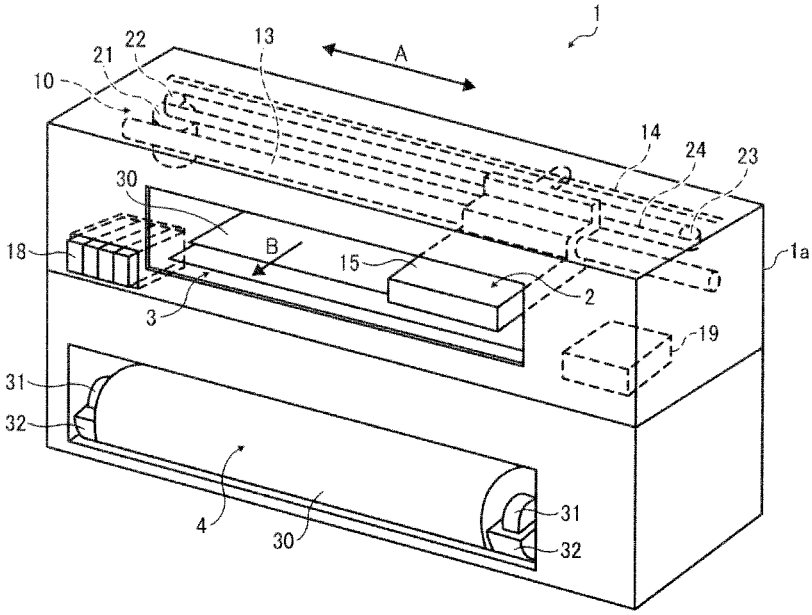
FIG. 1 is a schematic perspective view of an inkjet recording apparatus including a sheet cutting device according to an exemplary embodiment of this disclosure.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIGS. 1 to 15 shows a sheet cutting device and an image forming apparatus according to an exemplary embodiment of the present disclosure. In FIGS. 1 to 15, an inkjet recording apparatus is illustrated as an example of the image forming apparatus.

In FIG. 1, an inkjet recording apparatus 1 serving as the image forming apparatus is a serial-type inkjet recording apparatus that moves an inkjet head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image. The image forming apparatus is not limited to the serial-type inkjet recording apparatus but may be, for example, a line-type inkjet recording apparatus having a recording head in which multiple nozzles are arranged across a substantially whole area in the width direction of a sheet to record an image on the sheet without scanning in the width direction.

The inkjet recording apparatus 1 includes an image forming section 2 serving as an image forming unit, a sheet feed section 3 serving as a sheet feed unit, a rolled sheet storage section 4, and a sheet cutting device 5. The image forming section 2, the sheet feed section 3, the rolled sheet storage section 4, and the sheet cutting device 5 are disposed within an apparatus main unit 1*a*.

In the image forming section 2, a guide rod 13 and a guide rail 14 are extended between side plates, and a carriage 15 is supported by the guide rod 13 and the guide rail 14 so as to be slidable in a direction indicated by an arrow A. In this exemplary embodiment, the carriage 15 serves as a head holder to hold recording heads as described below.

Figure 11:
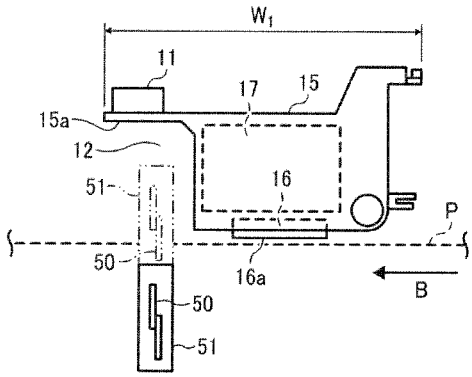
FIG. 11 is a side view of an arrangement of a carriage and the cutter holder.

As illustrated in FIG. 11, the carriage 15 holds inkjet heads (recording heads) 16 having multiple rows of nozzles to eject ink droplets of, e.g., black (K), yellow (Y), magenta (M), and cyan (C). The recording heads 16 are installed in the carriage 15 so as to eject ink droplets downward. Thus, at a lower end of each of the recording heads 16, a nozzle face 16*a* having multiple rows of nozzles is disposed so as to oppose a rolled sheet 30 (see FIG. 2) on a sheet feed path indicated by a broken line P in FIG. 11. The recording heads 16 may include, for example, piezoelectric actuators, such as piezoelectric elements, as energy generators for ejecting ink droplets. In this exemplary embodiment, the nozzle face 16*a* of each of the recording heads 16 serves as a sheet opposing face to oppose the sheet.

The carriage 15 is integrally provided with sub tanks 17 to supply different color inks to the respective recording heads 16. The sub tanks 17 are replenished with different color inks from main cartridges 18 (see FIG. 1) via dedicated supply tubes 11. An upper protruding portion 15*a* of the carriage 15 on a downstream side in a direction in which the sheet is fed (hereinafter, sheet feed direction) protrudes forward, that is, toward a downstream side in the sheet feed direction. The supply tubes 11 are wound around an upper face of the upper protruding portion 15*a* of the carriage 15 on the downstream side in the sheet feed direction.

As illustrated in FIG. 1, a main scanning mechanism 10 moves the carriage 15 for scanning in a main scanning direction, that is, the sheet width direction indicated by the arrow A. The main scanning mechanism 10 includes a driving motor 21 disposed at a first end in the sheet width direction, a driving pulley rotated by the driving motor 21, a driven pulley 23 disposed at a second end opposite the first end in the sheet width direction, and a belt member 24 looped around the driving pulley 22 and the driven pulley 23. A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction.

To detect a main scanning position of the carriage 15 in the main scanning direction, an encoder sheet is disposed along the sheet width direction in which the carriage 15 moves. An encoder sensor disposed at the carriage 15 reads the encoder sheet to detect the main scanning position of the carriage 15.

In a recording area of a main scanning region of the carriage 15, the rolled sheet 30 is intermittently fed by the sheet feed section 3 in a direction perpendicular to the sheet width direction, that is, the sheet feed direction indicated by an arrow B in FIG. 1.

Outside a range of movement of the carriage 15 in the sheet width direction or at a first end side of the main scanning region of the carriage 15, the main cartridges 18 are removably mounted to the apparatus main unit 1*a* to store the respective color inks to be supplied to the sub tanks 17 (see FIG. 11) of the recording heads 16. At a second end side of the main scanning region opposite the first end side, a maintenance unit 19 is disposed to maintain and recover desirable conditions of the recording heads 16.

The rolled sheet storage section 4 serves as a sheet feed unit into which the rolled sheet 30 serving as a sheet material for image recording is set. As the rolled sheet 30, rolled sheets of different widths can be set to the rolled sheet storage section 4. The rolled sheet 30 includes a sheet shaft, and flanges 31 are mounted at opposite ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumference of the flanges 31 to feed the rolled sheet 30 to the sheet feed path.

Figure 2:
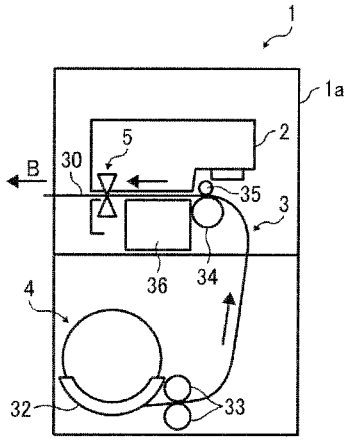
FIG. 2 is a schematic side view of the inkjet recording apparatus illustrated in FIG. 1.

As illustrated in FIG. 2, the sheet feed section 3 includes a pair of sheet feed rollers 33, a registration roller 34, a registration pressing roller 35, and a sheet suction feeding mechanism 36. The pair of sheet feed rollers 33 feeds the rolled sheet 30 from the rolled sheet storage section 4 to the sheet feed path. The registration roller 34 and the registration pressing roller 35 are disposed upstream from the image forming section 2 in the sheet feed direction to feed the rolled sheet 30 to the sheet cutting device 5 via the image forming section 2. The sheet suction feeding mechanism 36 has a platen at an upper face of the sheet suction feeding mechanism 36 and is disposed below the image forming section 2 across the sheet feed path to suction the rolled sheet 30 onto the platen and keep the rolled sheet 30 flat.

After the rolled sheet 30 is fed from the rolled sheet storage section 4, the sheet feed section 3 feeds the rolled sheet 30 forward (toward the left side in FIG. 2) from the rear side (right side in FIG. 2) of the apparatus main unit 1*a* to the predetermined recording area below the image forming section 2. When the rolled sheet 30 is fed to the recording area, the carriage 15 moves back and forth in the sheet width direction and the recording heads 16 eject ink droplets in accordance with image information. In addition, while the rolled sheet 30 is intermittently fed forward, the recording heads 16 repeatedly eject ink droplets onto the rolled sheet 30 to record lines of a desired image on the rolled sheet. Thus, the whole image is formed on the rolled sheet 30 in accordance with the image information.

After image formation, the sheet cutting device 5 cuts the rolled sheet 30 to a desired length, and the cut sheet is discharged to a sheet output tray at the front side of the apparatus main unit 1*a*.

Next, the sheet cutting device 5 in this exemplary embodiment is described with reference to FIGS. 3 to 7.

Figure 3:
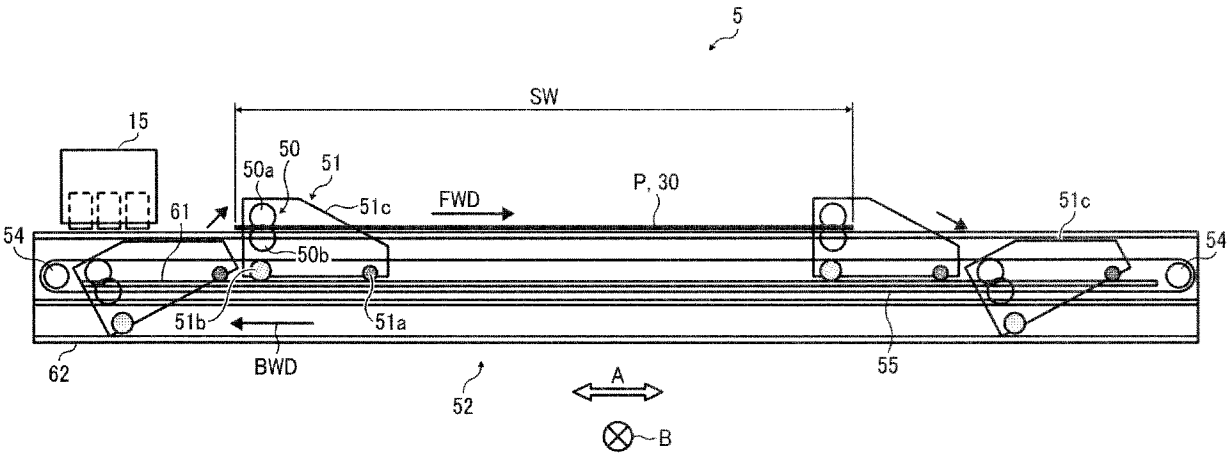
FIG. 3 is a schematic back view of the sheet cutting device according to an exemplary embodiment of this disclosure.

FIG. 3 is a schematic view of the sheet cutting device 5 seen from the back side of the apparatus main unit 1*a*.

The sheet cutting device 5 is disposed downstream from the image forming section 2 in the sheet feed direction (see FIG. 2) and has a cutter 50, a cutter holder 51, and a guide member 52 as illustrated in FIG. 3.

The cutter 50 is formed with circular blades 50*a* and 50*b*. The circular blades 50*a* and 50*b* are disposed opposing each other and rotatably held by the cutter holder 51. The circular blades 50*a* and 50*b* rotate with movement of the cutter holder 51 in the sheet width direction indicated by the arrow A in FIG. 2. In other words, the cutter 50 rotates the circular blades 50*a* and 50*b* to cut the rolled sheet 30 and is capable of cutting, e.g., a relatively thick rolled sheet. Additionally, the cutter 50 is formed with the circular blades, thus preventing a failure, such as uneven wearing of a particular portion as in a stationary blade. It is to be noted that the number of circular blades is not limited to two and may be three or more. The circular blades 50*a* and 50*b* in this exemplary embodiment serve as cutting portions.

The cutter holder 51 is reciprocally movable back and forth in the sheet width direction. When the cutter 50 moves along a forward path (indicated by an arrow FWD in FIG. 3) from the second end side to the first end side of the apparatus main unit 1*a* (see FIG. 1), the cutter 50 cuts the rolled sheet 30. By contrast, when the cutter 50 moves along a backward path (indicated by an arrow BWD in FIG. 3) from the first end side to the second end side of the apparatus main unit 1*a* (see FIG. 1), the cutter holder 51 returns to an initial position (hereinafter, home position) with the cutter holder 51 retracted from the sheet feed path downward in a thickness direction (sheet thickness direction) of the sheet, that is, the vertical direction. As a result, on the backward path, the cutter holder 51 is separated from the sheet feed path (indicated by a solid line P in FIG. 3) so as not to block the sheet feed path. The cutter holder 51 is controlled based on positions detected with detectors, e.g., micro switches, disposed at opposite ends in the sheet width direction. The configuration of the cutter holder 51 is as follows.

The cutter holder 51 has a driving roller 51*a* and a driven roller 51*b*, and holds the cutter 50 inside. The driving roller 51*a* is connected to a wire 55 extended between a pair of pulleys 54 at opposite ends of the apparatus main unit 1*a* in the sheet width direction. The wire 55 circulates in the sheet width direction via the pair of pulleys 54 rotated by a driving motor. As a result, the driving roller 51*a* is rotationally moved on an upper guide rail 61 in accordance with the circulation of the wire 55. The cutter holder 51 is movable in the sheet width direction in accordance with the movement of the driving roller 51*a*. The driven roller 51*b* is rotatably disposed at a position away from the driving roller 51*a* in the sheet width direction. The driven roller 51*b* moves on the upper guide rail 61 along the forward path of the cutter holder 51 and on a lower guide rail 62 along the backward path. In other words, during the movement of the cutter holder 51, the driven roller 51*b* functions as a positioning member to position the cutter holder 51 with respect to the upper guide rail 61 and the lower guide rail 62. The positioning member of the cutter holder 51 is not limited to the driven roller 51*b* but may be, for example, a circular-arc protrusion.

On switching between the forward path and the backward path, the cutter holder 51 pivots in the vertical direction around the driving roller 51*a*. Thus, the cutter holder 51 switches between a first position with which the cutter holder 51 cuts the rolled sheet 30 along the forward path and a second position with which the cutter holder 51 is retracted from the sheet feed path.

Figure 4A:
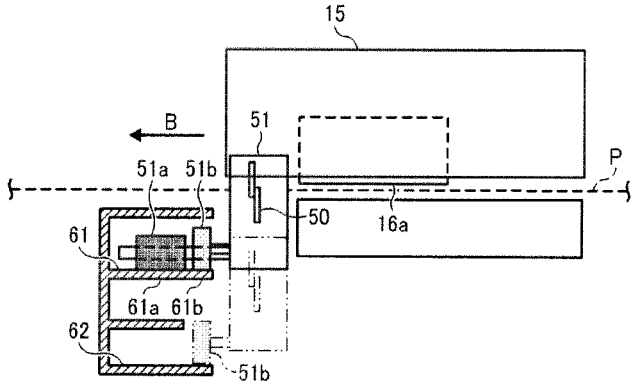
FIG. 4A is a cross-sectional side view of a portion of the sheet cutting device.

As illustrated in FIG. 4A, the driving roller 51*a* and the driven roller 51*b* are offset from each other in the sheet feed direction indicated by the arrow B. Specifically, the driven roller 51*b* is arranged upstream from the driving roller 51*a* in the sheet feed direction. As a result, with the driving roller 51*a* held on the upper guide rail 61, the driven roller 51*b* becomes movable between the upper guide rail 61 and the lower guide rail 62, thus allowing the cutter holder 51 to pivot around the driving roller 51*a*. In FIG. 4A, a broken line P extending in the direction indicated by the arrow B represents the sheet feed path.

As illustrated in FIG. 3, the cutter holder 51 has a slanted face 51*c* slanted at a predetermined angle from the sheet feed path (indicated by the solid line P) toward the vertical direction. The slant angle of the slanted face 51*c* is set so that the slanted face 51*c* is parallel to the sheet feed path when the cutter holder 51 moves along the backward path.

As illustrated in FIG. 3, the guide member 52 is a guide member to guide the movement of the cutter holder 51 in the sheet width direction, and includes the upper guide rail 61, extending in the sheet width direction for a length that is at least longer than the width (sheet feed width) of the sheet feed path indicated by an arrow SW, and the lower guide rail 62 disposed away from the sheet feed path downward in the vertical direction. The guide member 52 forms the forward path of the cutter holder 51 on the upper guide rail 61 and the backward path of the lower guide rail 62 on the lower guide rail 62. In this exemplary embodiment, the upper guide rail 61 and the lower guide rail 62 are formed as a single member (the guide member 52). Alternatively, the upper guide rail 61 and the lower guide rail 62 may be formed as separate members.

Figure 4B:
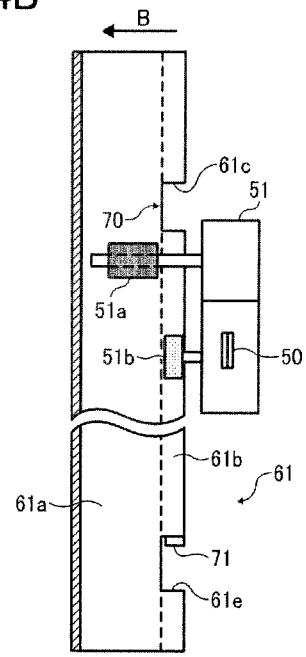
FIG. 4B is a cross-sectional plan view of a portion of the sheet cutting device.

As illustrated in FIGS. 4A and 4B, the upper guide rail 61 has a driving-roller guide area 61*a* to guide the driving roller 51*a* in the sheet width direction and a driven-roller guide area 61*b* to guide the driven roller 51*b* so that the cutter holder 51 moves along the forward path. In this exemplary embodiment, the driving-roller guide area 61*a* and the driven-roller guide area 61*b* are formed as a single rail, that is, the upper guide rail 61. Alternatively, the driving-roller guide area 61*a* and the driven-roller guide area 61*b* may be formed as separate rails.

Figure 6:
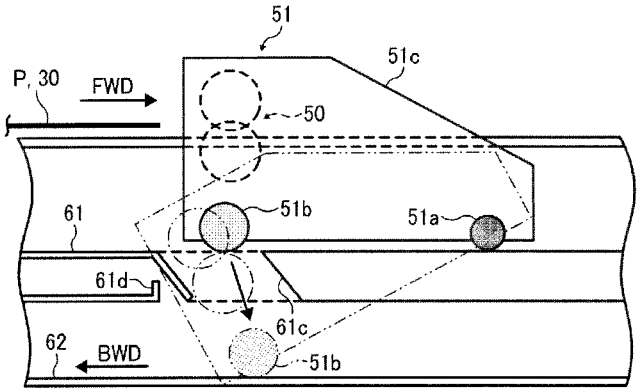
FIG. 6 is a schematic view of the cutter holder shifting to a backward path.

At a first end side of the driven-roller guide area 61*b* in the sheet width direction, a first connection path 61*c* is formed to switch the path of the cutter holder 51 from the forward path to the backward path. As illustrated in FIG. 6, the first connection path 61*c* is formed at the upper guide rail 61 so as to connect the forward path (indicated by an arrow FWD) on the upper guide rail 61 to the backward path (indicated by an arrow BWD)on the lower guide rail 62. Specifically, a predetermined portion of the upper guide rail 61 is cut out at the first end side in the sheet width direction and folded so as to slant downward at a certain angle, thus forming the first connection path 61*c*. Thus, the first connection path 61*c* allows the driven roller 51*b* to move from the upper guide rail 61 to the lower guide rail 62 after the rolled sheet is cut with the cutter 50. A lower end portion 61*d* of the upper guide rail 61 adjacent to the first connection path 61*c* is folded upward so as not to contact the driven roller 51*b* moving along the backward path.

Figure 5:
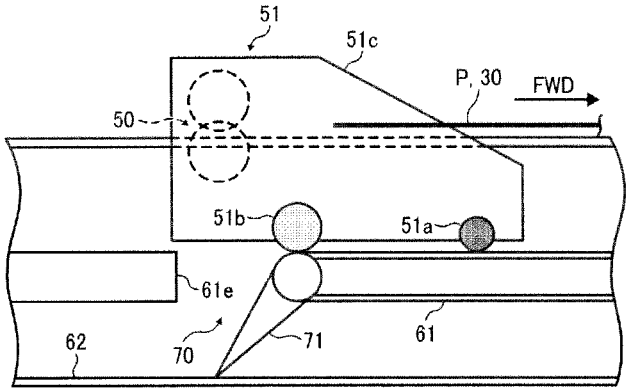
FIG. 5 is a schematic view of a cutter holder of the sheet cutting device having returned to a rolled-sheet cutting area.

As illustrated in FIG. 5, a moving mechanism 70 is disposed at a second end side of the driven-roller guide area 61*b* opposite the first end side in the sheet width direction. When the cutter holder 51 moves from the home position indicated by a solid line in FIG. 10 to the opposite end in the sheet width direction, the moving mechanism 70 moves the driven roller 51*b* from the lower guide rail 62 to the upper guide rail 61, that is, returns the cutter holder 51 to a cutting area (rolled-sheet cutting area) of the rolled sheet.

The moving mechanism 70 includes a second connection path 61*e* to connect the backward path on the lower guide rail 62 to the forward path on the upper guide rail 61, and a switching hook 71 disposed adjacent to the second connection path 61*e* at the upper guide rail 61.

The second connection path 61*e* is formed by cutting out a predetermined portion of the upper guide rail 61 at the second end side in the sheet width direction (see FIG. 4B).

Figure 9:
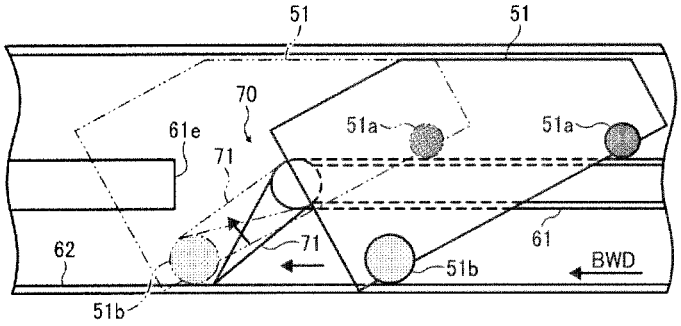
FIG. 9 is a schematic view of the cutter holder returning from the backward path to a home position.
Figure 10:
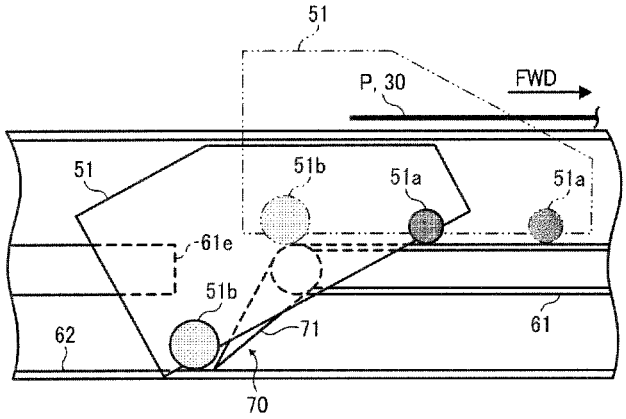
FIG. 10 is a schematic view of the cutter holder returning to the rolled-sheet cutting area.

The switching hook 71 pivots between the backward path and the second connection path 61*e* and is constantly urged downward by an urging member, e.g., a coil spring, so that a tip of the switching hook 71 contacts the lower guide rail 62. As a result, as illustrated in FIG. 9, when the cutter holder 51 moves along the backward path (indicated by an arrow BWD) to the second end side in the sheet width direction, the driven roller 51*b* contacts the switching hook 71 to pivot the switching hook 71 as indicated by a broken line. In this state, when the driven roller 51*b* further moves to the second end side in the sheet width direction, the switching hook 71 is separated from the driven roller 51*b* and returned by the urging member to an initial position, that is, a position indicated by a solid line in FIG. 9. At the initial position indicated by the solid line in FIG.9, the switching hook 71 is tilted at a predetermined angle. Thus, as illustrated in FIG. 10, when the cutter holder 51 returns from the backward path to the forward path, the driven roller 51*b* can be moved from the lower guide rail 62 to the upper guide rail 61 via the switching hook 71. The switching hook 71 may be, for example, a leaf spring. In such a case, the urging member is not necessary.

The lower guide rail 62 guides the driven roller 51*b* of the cutter holder 51 moving along the backward path.

Next, operation of the sheet cutting device 5 is described with reference to FIGS. 5 to 10.

First, as illustrated in FIG. 10, before the rolled sheet 30 is cut, the cutter holder 51 is placed at the home position (indicated by the solid line in FIG. 10) at the second end side in the sheet width direction. Next, when an instruction for sheet cutting is received, by rotating the driving roller 51*a* via the wire 55 (see FIG. 3), the cutter holder 51 is moved from the home position to the rolled-sheet cutting area (a position indicated by a broken line in FIG. 10), and then moved along the forward path (indicated by an arrow FWD in FIG. 10) to the first end side in the sheet width direction. At this time, the cutter 50 cuts the rolled sheet 30 in accordance with movement of the cutter holder 51.

Next, as illustrated in FIG. 6, when the cutter holder 51 moves along the forward path (indicated by an arrow FWD) to the first end side in the sheet width direction across the sheet feed path (indicated by a solid line P), the cutting of the rolled sheet 30 is finished.

Figure 7:
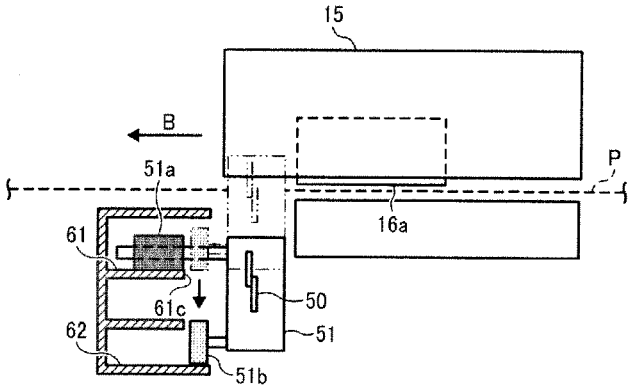
FIG. 7 is a cross-sectional side view of the portion of the sheet cutting device illustrated in FIG. 4A when the cutter holder shifts to the backward path.

After the cutter holder 51 moves to the first end side in the sheet width direction, the cutter holder 51 pivots downward in the vertical direction around the driving roller 51*a* under its own weight. Specifically, when the driven roller 51*b* moving on the upper guide rail 61 arrives at the first connection path 61*c*, the driven roller 51*b* moves from the upper guide rail 61 to the lower guide rail 62 via the first connection path 61*c*. At this time, as illustrated in FIG. 7, with the driving roller 51*a* retained on the upper guide rail 61, only the driven roller 51*b* moves to the lower guide rail 62 under its own weight. As a result, in FIG. 7, the cutter holder 51 overlapping the sheet feed path indicated by a broken line P pivots to take a position with which the cutter holder 51 is movable along the backward path, that is, the position (indicated by a broken line in FIG. 6) with which the cutter holder 51 is retracted from the sheet feed path.

Figure 8:
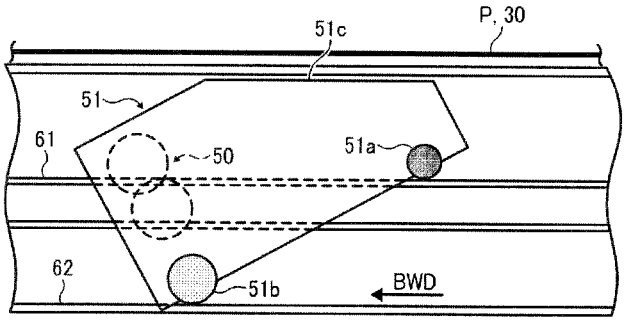
FIG. 8 is a schematic view of the cutter holder moving along the backward path.

Then, based on a position detected by a detector at the first end side in the sheet width direction, the wire 55 (see FIG. 3) is circulated in reverse to rotate the driving roller 51*a* in reverse, that is, in a direction opposite a direction in which the driving roller 51*a* rotates on the forward path. Thus, as illustrated in FIG. 8, with the position retracted from the sheet feed path indicated by the solid line P, the cutter holder 51 moves along the backward path (indicated by an arrow BWD) to the second end side in the sheet width direction. At this time, the slanted face 51*c* is parallel to the sheet feed path and, unlike on the forward path, the cutter holder 51 is retracted downward from the sheet feed path. Thus, when the cutter holder 51 moves along the backward path, the rolled sheet 30 can be fed along the sheet feed path.

Next, as illustrated in FIG. 9, when the cutter holder 51 moves to the second end side in the sheet width direction and arrives at a position adjacent to the moving mechanism 70, the driven roller 51*b* contacts the switching hook 71. With the movement of the cutter holder 51, the driven roller 51*b* pushes up the switching hook 71 as indicated by a broken line in FIG. 9, and moves from the backward path side (the right side of the switching hook 71 in FIG. 9) to the second end side in the sheet width direction, that is, the side of the second connection path 61*e* (the left side of the switching hook 71 in FIG. 9). When the driven roller 51*b* moves to the side of the second connection path 61*e*, the switching hook 71 is separated from the driven roller 51*b* and returned by the urging member to the initial position, that is, the position indicated by the solid line in FIG. 9.

Thus, the reciprocal movement of the cutter holder 51 in the sheet width direction is finished. If the rolled sheet 30 is subsequently fed, the above-described reciprocal movement is repeated.

Next, arrangement of the cutter holder 51 is described with reference to FIGS. 7, 11, and 12.

Figure 16:
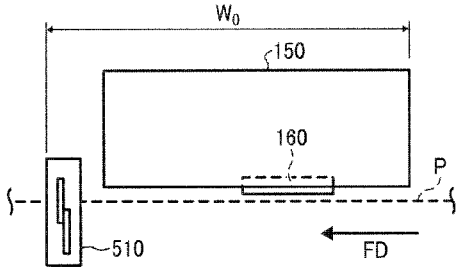
FIG. 16 RELATED ART
FIG. 16 is a side view of a conventional sheet cutting device.

As illustrated in FIG. 7, the cutter holder 51 and the carriage 15 are arranged so that the cutter holder 51 overlaps the carriage 15 in the vertical direction in the rolled-sheet cutting area of the cutter holder 51 (indicated by a broken line). Such a configuration can reduce the width of the apparatus main unit 1*a* in the sheet feed direction by the width of the cutter holder and a distance between the cutter holder and the carriage in the sheet feed direction as compared to the conventional arrangement illustrated in FIG. 16. In this exemplary embodiment, when the cutter holder 51 is positioned at one end of its range of movement at the first end side in the sheet width direction, as indicated by the broken line in FIG. 6, the cutter holder 51 is retracted downward in the vertical direction relative to the nozzle faces 16*a*. In addition, when the cutter holder 51 is positioned at the opposite end of its range of movement at the second end side in the sheet width direction, as indicated by the solid line in FIG. 10, the cutter holder 51 is retracted downward in the vertical direction relative to the nozzle faces 16*a*.

Next, as illustrated in FIG. 11, the cutter holder 51 in this exemplary embodiment is disposed downstream from the recording heads 16 in the sheet feed direction and within the width of the carriage 15 in the sheet feed direction, that is, a width $W_i$ in FIG. 11. Specifically, by using a space 12 below the upper protruding portion 15*a* of the carriage 15 on the downstream side in the sheet feed direction on which the supply tubes 11 are wound to replenish the sub tanks 17with different color inks from the main cartridges 18 (see FIG. 1), the cutter holder 51 is disposed so as to overlap the carriage 15 in the vertical direction. Such a configuration can reduce the width of the apparatus main unit 1*a* in the sheet feed direction by the difference between the widths $W_0$ and $W_1$ as compared to the conventional arrangement illustrated in FIG. 16.

As described above, the cutter holder 51 can switch routes between when the cutter holder 51 moves along the forward path and when the cutter holder 51 moves along the backward path. In particular, on the backward path, the cutter holder 51 is retracted downward in the vertical direction relative to the nozzle faces 16*a* of the recording heads 16. As a result, during movement of the carriage 15, the cutter holder 51 is movable along the backward path with the cutter holder 51 retracted downward in the vertical direction relative to the nozzle faces 16*a*.

Although, in FIG. 11, the driving roller 51*a*, the driven roller 51*b*, and the guide member 52 (see FIG. 3) are not illustrated, it is preferable to arrange the driving roller 51*a*, the driven roller 51*b*, and the guide member 52 within the width $W_1$ of the carriage 15 in the sheet feed direction.

Figure 12:
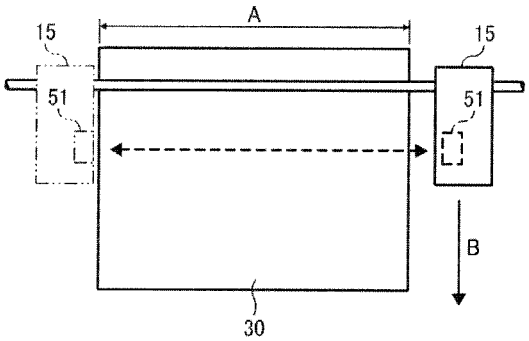
FIG. 12 is a plan view of the arrangement of the carriage and the cutter holder.

As illustrated in FIG. 12, the cutter holder 51 is also disposed so as to overlap the carriage 15 in the vertical direction at the opposite ends in the range of movement of the cutter holder 51 in the sheet width direction. Alternatively, the cutter holder 51 may be disposed so as to overlap the carriage 15 in the vertical direction at only one end of the opposite ends in the range of movement of the cutter holder 51 in the sheet width direction.

In addition, when the cutter holder 51 is positioned at any one of the opposite ends of the range of movement in the sheet width direction, the cutter holder 51 is retracted downward in the vertical direction relative to the nozzle faces 16 of the recording heads 16. In other words, when the cutter holder 51 is positioned at one end of the range of movement at the first end side in the sheet width direction, as indicated by the broken line in FIG. 6, the cutter holder 51 is retracted downward in the vertical direction relative to the nozzle faces 16*a* (see FIG. 11). In addition, when the cutter holder 51 is positioned at the opposite end of the range of movement at the second end side in the sheet width direction, as indicated by the solid line in FIG. 10, the cutter holder 51 is retracted downward in the vertical direction relative to the nozzle faces 16*a*.

In the above description, assuming that the rolled-sheet cutting area of the cutter holder 51 (indicated by the broken line) overlaps a position of the carriage 15 as illustrated in FIG. 7, the position of the cutter holder 51 indicated by the solid line in FIG. 10 is described as the home position. For example, as illustrated in FIG. 11, in a case in which the rolled-sheet cutting area of the cutter holder 51 does not overlap a position of the carriage 15, the position of the cutter holder 51 indicated by the broken line in FIG. 10 is set as the home position. Alternatively, the cutter holder 51 may be retracted relative to the nozzle faces 16*a* (see FIG. 11) at only one end of the opposite ends in the range of movement of the cutter holder 51 in the sheet width direction.

As described above, in the inkjet recording apparatus 1 according to this exemplary embodiment, the cutter holder 51 is disposed downstream from the recording heads 16 in the sheet feed direction and within an area of the width $W_1$ of the carriage 15 in the sheet feed direction. Such a configuration can reduce the width of the apparatus main unit 1*a* in the sheet feed direction as compared to the conventional configuration in which the cutter holder and the carriage are arranged independently of each other and in tandem in the sheet feed direction. As a result, the inkjet recording apparatus 1 can be made more compact.

In the inkjet recording apparatus 1 according to this exemplary embodiment, during movement of the carriage 15, the cutter holder 51 is movable in the sheet width direction with the cutter holder 51 retracted in the vertical direction relative to the nozzle faces 16*a* of the recording heads 16, thus preventing the cutter holder 51 from interfering with the carriage 15 during movement. As a result, in a case in which the sheet cutting device 5 is mounted in the serial-type inkjet recording apparatus 1, the cutter holder 51 can be disposed within the width $W_1$ of the carriage 15 in the sheet feed direction.

As illustrated in FIG. 11, the space 12 allows movement of the cutter holder 51 in the rolled-sheet cutting area. Such a configuration allows the cutter holder 51 to move during movement of the carriage 15, that is, during image recording, thus enhancing the productivity of the inkjet recording apparatus 1.

In the sheet cutting device according to this exemplary embodiment, when the cutter holder 51 is positioned at any one of the opposite ends of the range of movement in the sheet width direction, the cutter holder 51 is retracted in the vertical direction relative to the nozzle faces 16*a*. Such a configuration can prevent the cutter holder 51 from interfering with the carriage 15 during movement when the cutter holder 51 is on standby. Thus, for example, at the opposite ends in the sheet width direction, the cutter holder 51 and the carriage 15 can be arranged so as to overlap each other in the vertical direction. As a result, the width of the apparatus main unit 1*a* in the width direction can be shortened, thus allowing the inkjet recording apparatus 1 to be more compact.

Figure 13:
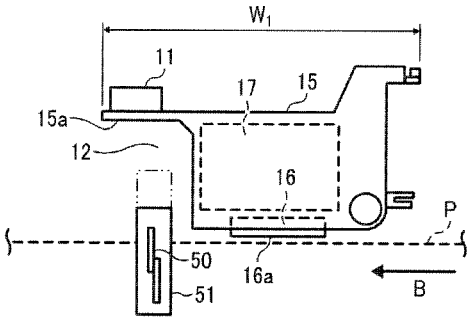
FIG. 13 is a side view of the cutter holder retracted to a position differing from a retracted position illustrated in FIG. 11.

In this exemplary embodiment, as illustrated in FIGS. 7 and 11, on the backward path, the cutter holder 51 is retracted downward in the vertical direction relative to the nozzle faces 16*a*. Alternatively, for example, as illustrated in FIG. 13, in moving along the backward path, the cutter holder 51 may be positioned lower than in moving along the forward path with an upper face of the cutter holder 51 being kept higher than the nozzle face 16*a* in the vertical direction. For example, depending on the arrangement of the sheet feed path, it may be unnecessary to retract the cutter holder 51 to a position lower than the nozzle face 16*a*. In such a case, the configuration illustrated in FIG. 13 is effective and, for example, the sheet feed path may be arranged so as to be inclined upward from a position downstream from the recording heads 16 to a position upstream from the recording heads 16 in the sheet feed direction.

Figure 14:
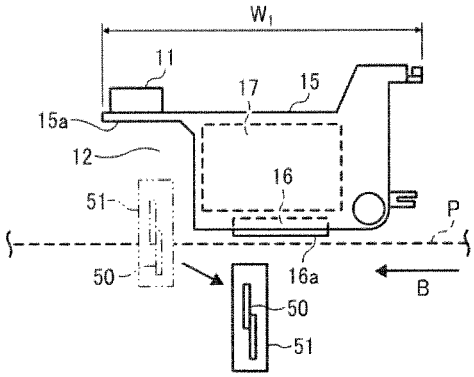
FIG. 14 is a side view of the cutter holder retracted to a position differing from any of the retracted positions illustrated in FIGS. 11 and 13.

In this exemplary embodiment, on the backward path, the cutter holder 51 is retracted in the vertical direction. Alternatively, for example, as illustrated in FIG. 14, on the backward path, the cutter holder 51 may be retracted to a position upstream in the sheet feed direction (indicated by an arrow B in FIG. 14) from the position (indicated by a broken line in FIG. 14) of the cutter holder 51 on the forward path, preferably, within the width of the recording heads 16 in the sheet feed direction below the nozzle faces 16*a*.

Figure 15:
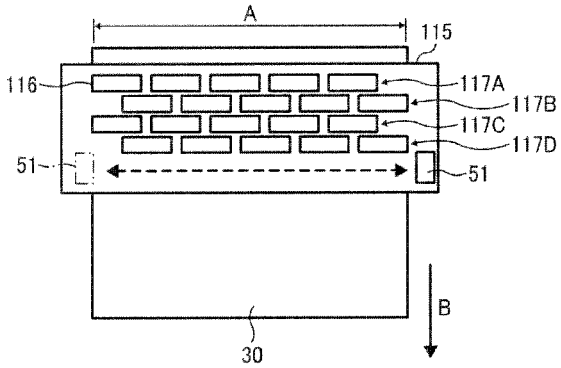
FIG. 15 is a plan view of a line-type inkjet recording apparatus including a sheet cutting device according to an exemplary embodiment of this disclosure.

In the forgoing exemplary embodiment, a case in which the sheet cutting device 5 is mounted in the serial-type inkjet recording apparatus 1 is described. Alternatively, as described above, the sheet cutting device 5 may be used with a line-type inkjet recording apparatus. In such a case, for example, as illustrated in FIG. 15, multiple head modules 117A, 117B, 117C, and 117D may be arranged in multiple rows and side by side in the sheet width direction indicated by an arrow A in FIG. 15. Each of the head modules 117A, 117B, 117C, and 117D has multiple recording heads 116 arranged in a line in the sheet width direction indicated by the arrow A in FIG. 15. The recording heads 116 of the head modules 117A, 117B, 117C, and 117D are also partially offset so that nozzle rows of the recording heads 116 partially overlap each other in the sheet feed direction. Each of the line-head-type recording heads 116 may have, for example, two nozzle rows in each of which multiple nozzles for ejecting ink are arranged in line. For example, yellow (Y) ink may be ejected from one of the two nozzle rows of each of the head modules 117A and 117B and magenta (M) ink from the other. In addition, cyan (C) ink may be ejected from one of the two nozzle rows of each of the head modules 117C and 117D and magenta (B) ink from the other. In other words, in this line-type inkjet recording apparatus, the two head modules 117A and 117B (or 117C and 117D) that eject the same colors are arranged side by side in the sheet feed direction, and the nozzle rows of the two head modules 117A and 117B (or 117C and 117D) form, in combination, a nozzle row group having a length corresponding to the width of sheet.

The recording heads 116 described above are one example of line-head-type recording heads and not limited to the above-described configuration. For example, line-head-type recording heads having a length corresponding to the width of sheet may be arranged in four lines in the sheet feed direction corresponding to four colors.

The recording heads 116 are held by a head holder 115 fixed in the apparatus main unit 1*a*. As with the above-described configuration, in this configuration, when the cutter holder 51 moves along the backward path or is positioned at any one of the opposite ends of the range of movement in the sheet width direction, the cutter holder 51 is retracted downward in the vertical direction relative to the nozzle face of each of the recording heads 116. Such a configuration can enhance the productivity of the inkjet recording apparatus 1. The cutter holder 51 is also disposed within the width of the head holder 115 in the sheet feed direction. The opposite ends of the range of movement of the cutter holder 51 in the sheet width direction are disposed within the width of the head holder 115 in the sheet width direction. Alternatively, only one end of the opposite ends of the range of movement in the sheet width direction may be disposed within the width of the head holder 115 in the sheet width direction. As described above, in a case in which the sheet cutting device 5 is used in the line-type inkjet recording apparatus, as with the above-described exemplary embodiment, the size of the apparatus main unit in both the sheet feed direction and the sheet width direction can be shortened, thus allowing the line-type inkjet recording apparatus to be more compact.

In this exemplary embodiment, the cutter holder 51 has the driving roller 51*a* at the first end side in the sheet width direction and the driven roller 51*b* at the second end side in the sheet width direction. However, the configuration of the cutter holder 51 is not limited to such a configuration, and for example, the positions of the driving roller 51*a* and the driven roller 51*b* are interchangeable. In such a case, the cutter holder 51 pivots in a direction opposite the pivot direction of the above-described exemplary embodiment. Accordingly, the arrangement of the slanted face 51*c* is modified according to the pivot direction.

In this exemplary embodiment, the cutter holder 51 is retracted downward in the vertical direction. Alternatively, for example, in a case in which the sheet cutting device 5 is not horizontally disposed relative to the apparatus main unit 1*a*, the cutter holder 51 may be retracted in the thickness direction of the rolled sheet 30 in accordance with the inclination of the sheet cutting device 5.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to eject ink onto a sheet of recording media fed along a sheet feed path to record an image on the sheet;

a head holder holding the recording head;

a cutter including opposed blades opposing each other; and a cutter holder holding the cutter and reciprocally movable in a width direction of the sheet perpendicular to a sheet feed direction in which the sheet is fed along the sheet feed path, the cutter holder disposed downstream from the recording head in the sheet feed direction and within a width of the head holder in the sheet feed direction, wherein the cutter holder holding the cutter is retractable to a retracted position below a plane of the sheet, and while the cutter is cutting the sheet, the cutter holder moves with a portion of the cutter holder disposed higher than the sheet, and when the cutter holder moves while not cutting the sheet, the cutter holder moves with the cutter holder retracted below the plane of the sheet.

2. The image forming apparatus according to claim 1, wherein the head holder is a carriage reciprocally movable in the width direction of the sheet to enable the recording head to record the image on the sheet, the cutter holder being movable in the width direction of the sheet with the cutter holder retracted in a thickness direction of the sheet perpendicular to both the sheet feed direction and the width direction of the sheet relative to an opposing face of the recording head opposing the sheet.

3. The image forming apparatus according to claim 2, wherein the cutter holder overlaps the head holder in the thickness direction of the sheet at one or more of two opposed ends of a range of movement of the cutter holder in the width direction of the sheet.

4. The image forming apparatus according to claim 1, wherein the cutter holder s retractable to the retracted position at one or more of two opposed ends of a range of movement of the cutter holder in the width direction of the sheet.

5. The image forming apparatus according to claim 1, wherein the head holder has a protruding portion protruding from an upper portion of the head holder toward a downstream side in the sheet feed direction to form a space at a position opposing the cutter holder in a thickness direction of the sheet and downstream from the recording head in the sheet feed direction below the protruding portion, and the cutter holder is movable within the space.

6. The image forming apparatus according to claim 5, further comprising a supply tube disposed on the protruding portion above the space to supply ink for image recording.

7. The image forming apparatus according to claim 1, wherein the recording head is a line-head-type recording head.

8. The image forming apparatus according to claim 1, wherein one of he opposed blades is disposed higher in the cutter holder than the other opposed blade.

9. An image forming apparatus comprising:

a recording head to eject ink onto a sheet of recording media fed along a sheet feed path to record an image on the sheet;

a head holder holding the recording head and reciprocally movable in a width direction of the sheet perpendicular to a sheet feed direction in which the sheet is fed along the sheet feed path;

a cutter including opposed blades opposing each other; and a cutter holder holding the cutter and reciprocally movable in the width of the sheet independently of the head holder;

the cutter holder disposed downstream from the recording head in the sheet feed direction and within a width of the head holder in the sheet feed direction, wherein the cutter holder holding the cutter is retractable to a retracted position below a plane of the sheet, and while the cutter is cutting the sheet the cutter holder moves with a portion of the cutter holder disposed higher than the sheet, and when the cutter holder moves while not cutting the sheet, the cutter holder moves with the cutter holder retracted below the plane of the sheet.

10. The image forming apparatus according to claim 9, wherein the head holder is a carriage reciprocally movable in the width direction of the sheet to enable the recording head to record the image on the sheet, the cutter holder being movable in the width direction of the sheet with the cutter holder being retracted in a thickness direction of the sheet perpendicular to both the sheet feed direction and the width direction of the sheet relative to an opposing face of the recording head opposing the sheet.

11. The image forming apparatus according to claim 10, wherein the cutter holder overlaps the carriage in the thickness direction of the sheet at one or more of two opposed ends of a range of movement of the cutter holder in the width direction of the sheet.

12. The image forming apparatus according to claim 9, wherein the cutter holder is retractable to the retracted position at one or more of two opposed ends of a range of movement of the cutter holder in the width direction of the sheet.

13. An image forming apparatus comprising:

a recording head to eject ink onto a sheet of recording media fed along a sheet feed path to record an image on the sheet;

a head holder holding the recording head and reciprocally movable in a width direction of the sheet perpendicular to a sheet feed direction in which the sheet is fed along the sheet feed path;

a cutter including opposed blades opposing each other;

a cutter holder including a driving roller and a driven roller and holding the cutter, where the cutter holder is reciprocally movable in the width direction of the sheet independently of the head holder; and a guide member including an upper guide rail and a lower guide rail;

the cutter holder disposed downstream from the recording head in the sheet feed direction and within a width of the head holder n the sheet feed direction, wherein one of the opposed blades is disposed higher in the cutter holder than the other opposed blade, the cutter holder holding the cutter is retractable to a retracted position below a plane of the sheet, such that, while the cutter is cutting the sheet, the cutter holder moves with a portion of the cutter holder disposed higher than the sheet, and when the cutter holder moves while not cutting the sheet, the cutter holder moves with the cutter holder retracted below the plane of the sheet, and the driving roller is rotationally movable on the upper guide rail along both a forward path and a backward path of the cutter holder, and the driven roller is rotationally movable on the upper guide rail along the forward path of the cutter holder and on the lower guide rail along the backward path of the cutter holder.

* * * * *